US011009235B2

(12) United States Patent
Balingao et al.

(10) Patent No.: US 11,009,235 B2
(45) Date of Patent: May 18, 2021

(54) DOMESTIC KITCHEN APPLIANCE WITH SIDEWALL COOLING

(71) Applicants: BSH Home Appliances Corporation, Irvine, CA (US); BSH Hausgeräte GmbH, Munich (DE)

(72) Inventors: Alfie Balingao, New Bern, NC (US); Suad Elkasevic, Winterville, NC (US); Brandon Kornegay, New Bern, NC (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 185 days.

(21) Appl. No.: 16/221,644

(22) Filed: Dec. 17, 2018

(65) Prior Publication Data

US 2020/0191405 A1 Jun. 18, 2020

(51) Int. Cl.
*F24C 15/00* (2006.01)
*F24C 15/02* (2006.01)

(52) U.S. Cl.
CPC ..... *F24C 15/006* (2013.01); *F24C 15/028* (2013.01)

(58) Field of Classification Search
CPC ..... F24C 15/006
USPC ..... 126/21 A
See application file for complete search history.

(56) References Cited

U.S. PATENT DOCUMENTS 3,169,871 A * 2/1965 Macchi ..... A21B 1/245 426/523
3,512,514 A * 5/1970 Vonasch ..... F24C 14/02 126/21 A
4,241,718 A * 12/1980 Barnett ..... F24C 15/006 126/19 R
4,354,084 A * 10/1982 Husslein ..... F24C 15/006 126/21 A
4,886,042 A * 12/1989 Bessler ..... F24C 15/08 126/21 R
5,451,744 A * 9/1995 Koopman ..... A47J 37/042 219/400
5,676,044 A * 10/1997 Lara, Jr. ..... A21B 1/245 126/21 A
10,006,639 B2 6/2018 Johnson
2001/0004077 A1* 6/2001 Lee ..... H05B 6/6473 219/757
2016/0025352 A1 1/2016 Lee et al.
2016/0178216 A1* 6/2016 Lee ..... F24C 15/2007 126/21 A

FOREIGN PATENT DOCUMENTS

DE 102010062147 A1 6/2011
FR 2935780 A1 3/2010
WO 2015165530 A1 11/2015

* cited by examiner

*Primary Examiner* — Avinash A Savani
(74) *Attorney, Agent, or Firm* — Michael E. Tschupp; Andre Pallapies; Brandon G. Braun

(57) ABSTRACT

A domestic kitchen appliance is provided that has a housing having a side panel and a rear panel; a cooking chamber inside the housing; a door that is operable to access the cooking chamber; a corner flange located at a corner of the housing between an area in front of the housing and an area adjacent to the side panel; and a plurality of flange openings in the corner flange, the flange openings fluidly connecting the area in front of the housing to the area adjacent to the side panel.

19 Claims, 4 Drawing Sheets

DOMESTIC KITCHEN APPLIANCE WITH SIDEWALL COOLING

FIELD OF THE INVENTION

The invention is directed to a domestic cooking appliance. More particularly, embodiments of the invention are directed to a sidewall cooling system for a domestic cooking appliance.

An example of an application for the invention is a domestic kitchen cooking appliance in which air flow around the sides of the appliance is induced and controlled to cool the sides of the appliance.

BACKGROUND OF THE INVENTION

Some modern domestic kitchens include cooking appliances such as, for example, ranges and built-in stoves. In many of these kitchens, cooking appliances or other appliances that produce heat are installed in cabinets or other configurations in which the surrounding environment has a limited tolerance to heat. In some situations, regulations limit the temperature of particular portions of kitchen appliances.

Applicants recognized an improvement to the above arrangements and implement those improvements in embodiments of the invention.

SUMMARY

The invention achieves the benefit of providing adequate cooling to side areas of kitchen appliances.

Embodiments of the invention are based on the inventor's recognition that some kitchen appliances, such as, for example, cooking appliances, have side panels (or other panels) that are heated to undesirable levels by the heat produced by the appliance. The inventors further recognized that it is advantageous to direct cooling air over the side panels in order to remove some of this undesirable heat.

Embodiments of the invention are directed to systems and methods to direct cooling air from the front of a domestic kitchen appliance and into holes that are placed such that the cooling air is directed over the side panel before it is drawn in to the holes.

Particular embodiments of the invention are directed to a domestic kitchen appliance having a housing having a side panel and a rear panel; a cooking chamber inside the housing; a door that is operable to access the cooking chamber; a flange extending from the housing; a plurality of flange openings in the flange, the flange openings fluidly connecting an area in front of the housing to an area adjacent to the side panel; an upper opening in the housing, the upper opening being located above the side panel and fluidly connecting the area adjacent to the side panel and outside the housing to an area inside the housing; a rear opening in the rear panel, the rear opening fluidly connecting an area adjacent to the rear panel and outside the housing to an area inside the housing; an air mover that draws air into the upper opening; and an air mover that draws air into the rear opening.

In some embodiments, the flange is a corner flange located at a corner of the housing between the area in front of the housing and the area adjacent to the side panel.

Other embodiments of the invention are directed to a domestic kitchen appliance having a housing having a side panel and a rear panel; a cooking chamber inside the housing; a door that is operable to access the cooking chamber; a corner flange located at a corner of the housing between an area in front of the housing and an area adjacent to the side panel; and a plurality of flange openings in the corner flange, the flange openings fluidly connecting the area in front of the housing to the area adjacent the side panel.

Other embodiments of the invention are directed to a method of cooling a side panel of a domestic kitchen appliance, the domestic kitchen appliance having a housing having a side panel and a rear panel, a cooking chamber inside the housing, a door that is operable to access the cooking chamber, a corner flange located at a corner of the housing between an area in front of the housing and an area adjacent to the side panel, a plurality of flange openings in the corner flange, an upper opening in the housing, the upper opening being located above the side panel, and a rear opening in the rear panel. The method includes drawing cooling air through the flange openings from the area in front of the housing, over the side panel, and into the upper opening; and drawing cooling air through the flange openings from the area in front of the housing, over the side panel, and into the rear opening.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

As explained above, some installations of kitchen appliances, in particular cooking appliances, have regulatory or other limitations on the temperature of side panels of the appliances. Embodiments of the invention address this issue by providing increased cooling air flow over the side panels of kitchen appliances. In embodiments of the invention, air is drawn into holes (that are placed in particular locations) in the appliance housing, and openings are placed near the front of the appliance to allow cooling air to be drawn from the front of the appliance, over the side panels, and into the holes. Embodiments of the invention are particularly advantageous in installations where two cooking appliances are installed side-by-side and close to one another. In such installations the space between the two cooking appliances is heated by both appliances and particularly benefits from the cooling provided by embodiments of the invention.

Figure 1:
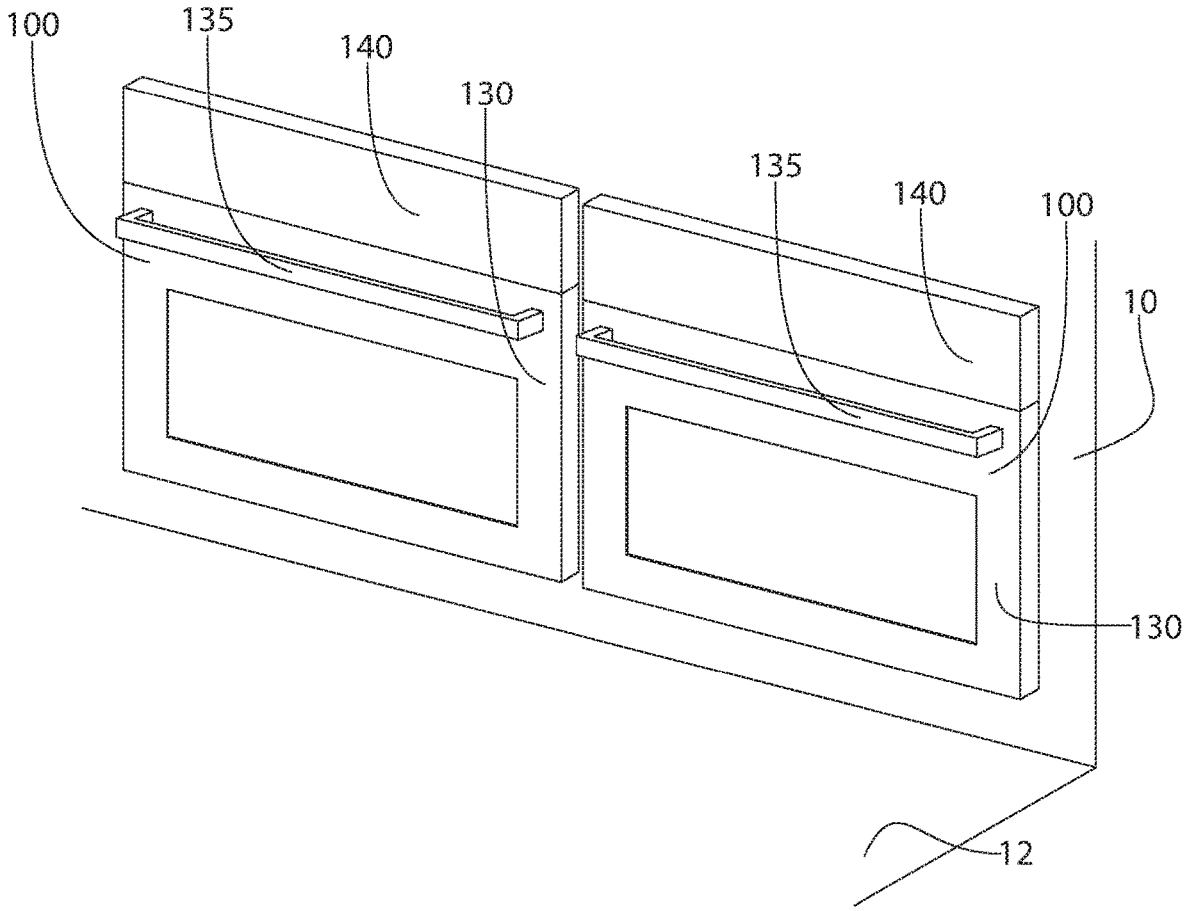
FIG. 1 is a perspective view of exemplary appliances in accordance with embodiments of the invention.

FIG. 1 shows an example of an embodiment of the invention including two ovens 100 installed in a cabinet or wall 10 in a kitchen 12. In this example, each oven 100 has a door 130 that allows access to a cooking chamber 120 (FIG. 2) in which a food item is placed to be heated by one or more heating elements (not shown). Each door 130 has a handle 135 that is used to open and close door 130. In this example, each oven 100 has a control panel 140 that contains various controls and displays for a user to interface with oven 100. While FIG. 1 shows one example of the invention, it is noted that other configurations of the invention have one oven or multiple ovens in different configurations.

Figure 2:
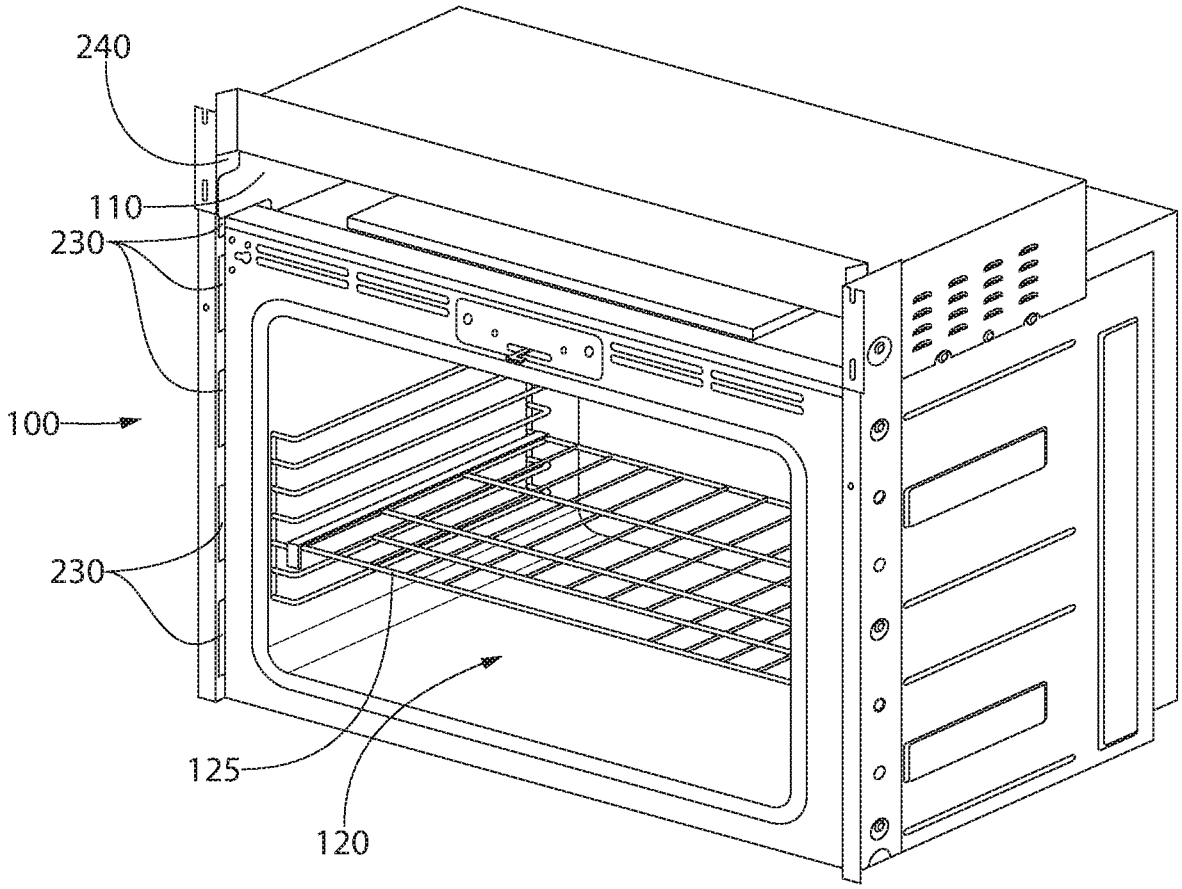
FIG. 2 is a perspective view of an appliance in accordance with exemplary embodiments of the invention.
Figure 3:
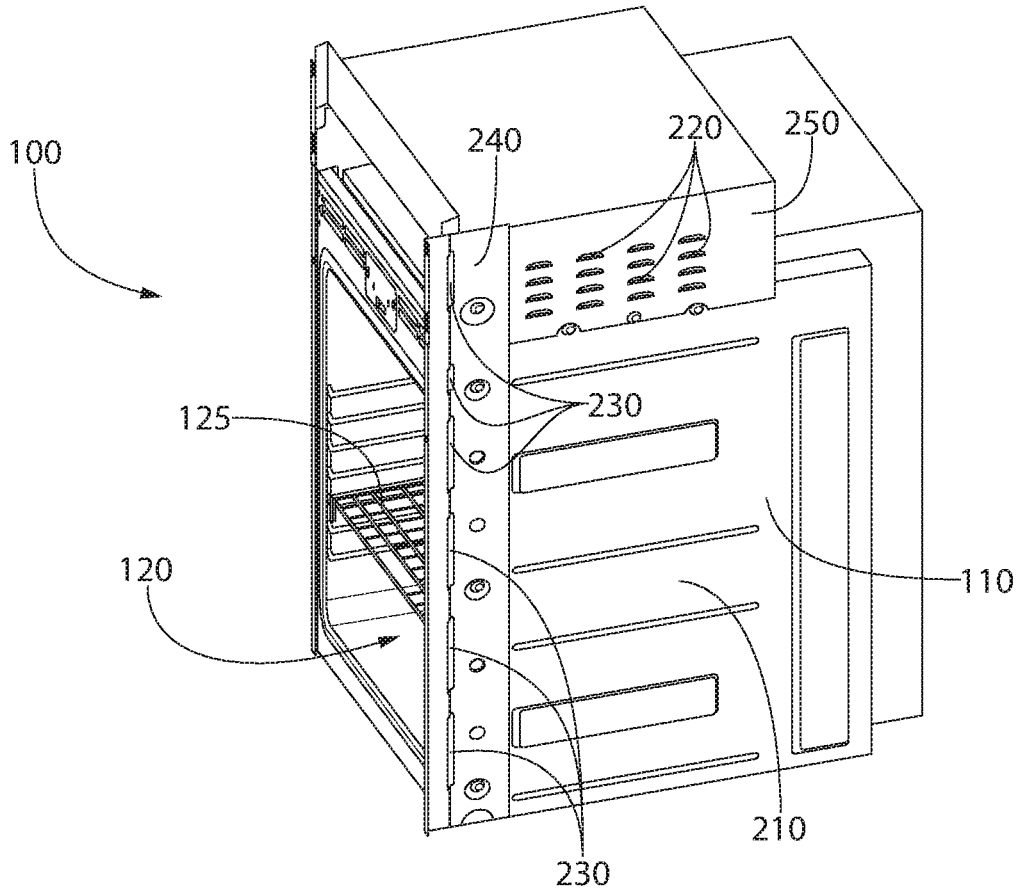
FIG. 3 is a perspective view of an appliance in accordance with exemplary embodiments of the invention.
Figure 4:
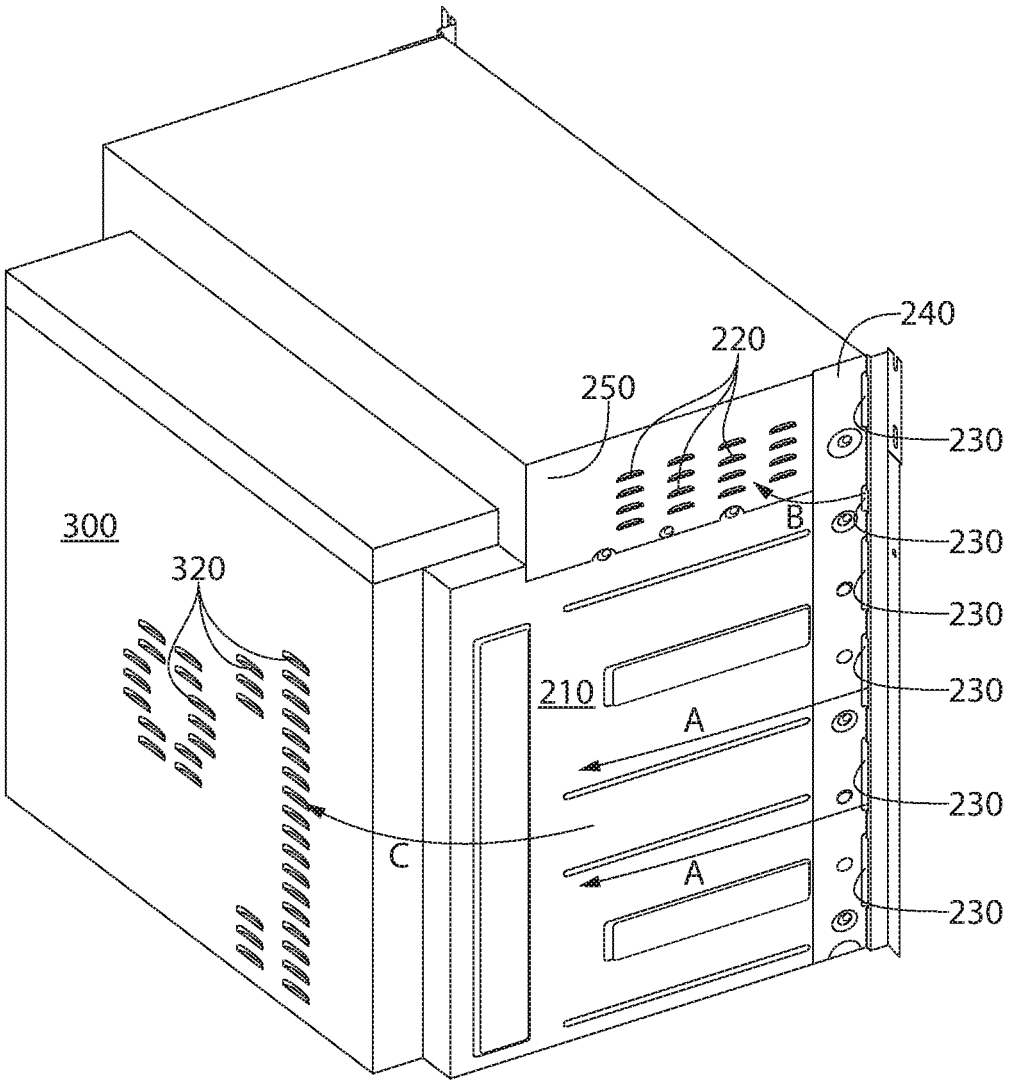
FIG. 4 is a perspective view of an appliance in accordance with exemplary embodiments of the invention.

FIGS. 2-4 show an example of oven 100 with door 130 removed for clarity. In this example, one or more racks 125 are provided in cooking chamber 120 for supporting food to be heated by oven 100. Oven 100 has a housing 110 that is formed by multiple pieces of, for example, sheet metal. Housing 110 can be one piece or multiple pieces and can have multiple cavities that house various components of oven 100. For example, certain parts of housing 110 can house fans or other air movers that push or pull air through various areas and/or openings in housing 110.

In the example shown in FIGS. 2-4, a flange 240 is provided at each of the front corners of housing 110. In this example, each flange 240 is shaped such that it is attached by screws to a side panel 210 of housing 110. Flange 240 includes, in this example, several bends so that flange 240 includes a portion that is configured to be screwed to cabinet/wall 10 to at least partially hold oven 100 in the desired position. In embodiments, flange 240 can be sheet metal or some other material that is sufficiently strong and dimensionally stable to hold oven 100 in the desired position during use. In other embodiments, flange 240 is a decorative piece that simply covers a gap between oven 100 and cabinet/wall 10. Flange 240 has a plurality of openings 230 that provide passageways for air to move from an area in front of oven 100 to an area adjacent to side panel 210. In the example shown, flange 240 is a separate piece from side panel 210. In other embodiments, flange 240 is an extension of a front edge of side panel 210.

In embodiments, flange 240 includes a portion that extends forward and parallel to a side surface of door 130. A space is provided between the side surface of door 130 and this portion to allow air from in front of appliance/oven 100 to access openings 230 around the side of door 130 when door 130 is in a closed position.

If flange 240 was provided without openings 230, since flange 240 is securely screwed to cabinet/wall 10, little or no air could move from the area in front of oven 100 to the area adjacent to side panel 210. By including openings 230 in flange 240, embodiments of the invention provide passageways for cooling air to be drawn from the area in front of oven 100 (where the air is generally cooler than air that is inside cabinet/wall 10) and over side panel 210.

FIGS. 3 and 4 show a plurality of upper holes 220 formed in an upper panel 250 of housing 110. Upper panel 250 is, in this example, part of an enclosure that houses various control electronics and a fan that draws air through upper holes 220. As shown in FIG. 4, air that is drawn into upper holes 220 originates from the area in front of oven 100, travels through openings 230, and follows the path of arrow B. This path of airflow results because there are few, if any, openings other than openings 230 for air to enter the space between oven 100 and cabinet/wall 10.

In some embodiments, a plurality of rear holes 320 are provided in a rear panel 300 that is located at the rear of oven 100. A fan or other air mover is provided to draw air into rear holes 320 from an area behind oven 100. Air that is drawn from the area behind oven 100 enters that space from the area adjacent to side panel 210 (following the path of arrow C). As air is drawn from the area adjacent to side panel 210, the resulting low pressure adjacent to side panel 210 causes air to be drawn in though openings 230 (following the path of arrows A). This air flow causes cooler air from the area in front of oven 100 to be drawn in through openings 230, over side panel 210, around the rear corner of housing 110, and into rear holes 320. This flow of cooler air removes heat from side panel 210 as it flows over side panel 210, causing a reduction in the temperature of side panel 210. In embodiments, rear holes 320 are located at a lower elevation than upper holes 220 so that at least a portion of the air drawn through openings 230 is pulled across a lower portion of side panel 210. In embodiments, some or all of rear holes 320 are located below a vertical midpoint of rear panel 300 in order to promote airflow over the lower portion of side panel 210.

In embodiments, one fan or other air mover is used to draw the airflow into both upper holes 220 and rear holes 320. In other embodiments, one fan or other air mover is used for upper holes 220 and a separate fan or air mover is used for rear holes 320.

In embodiments, the fan or fans used to draw air from upper holes 220 and rear holes 320 are activated by a switch that is controlled by a thermostat that monitors the temperature in the area adjacent to side panel 210. When the temperature in the area adjacent to side panel 210 rises above a predetermined temperature, the fan and/or fans are activated to draw cooling air through openings 230 and over side panel 210. In other embodiments, the fan or fans are activated at all times that appliance 100 is in an operating condition.

Although arrows A, B, C are shown on only one side of appliance 100, it is noted that in embodiments of the invention this air flow takes place on both sides of appliance 100.

In embodiments, the air that is drawn into upper holes 220 and/or rear holes 320 is channeled through ducts to other areas inside housing 110 and eventually to the environment outside of appliance 100. In embodiments, the air that is drawn into upper holes 220 and/or rear holes 320 is channeled through ducts directly to the environment outside of appliance 100.

In example shown in the Figures, a plurality of horizontally oriented ribs and protrusions are shown in side panel 210. The horizontally oriented ribs and protrusions aid in channeling the cooling air to the rear of oven 100 and partially resist movement of the cooling air upward toward upper openings 220.

Embodiments of the invention use various configurations of flange 240 and openings 230 that provide an airflow path that fluidly connects the area in front of the appliance 100 and the area adjacent to side panel 210. Some embodiments provide fewer or more openings 230 than the number shown in the Figures. Some embodiments provide different shaped openings 230 than shown in the Figures. Some embodiments provide fewer or more upper holes 220 than the number shown in the Figures. Some embodiments provide different shaped upper holes 220 than shown in the Figures. Some embodiments provide fewer or more rear holes 320 than the number shown in the Figures. Some embodiments provide different shaped rear holes 320 than shown in the Figures.

It will be appreciated that variants of the above-disclosed and other features and functions, or alternatives thereof, may be combined into many other different systems or applications. Any of the features described above can be combined with any other feature described above as long as the combined features are not mutually exclusive. Various presently unforeseen or unanticipated alternatives, modifications, variations or improvements therein may be subsequently made by those skilled in the art which are also intended to be encompassed by the invention.

What is claimed is:

1. A domestic kitchen appliance, comprising:

a housing having a side panel and a rear panel;

a cooking chamber inside the housing;

a door that is operable to access the cooking chamber;

a flange extending from the housing;

a plurality of flange openings in the flange, the flange openings fluidly connecting an area in front of the housing to an area adjacent to the side panel;

an upper opening in the housing, the upper opening being located above the side panel and fluidly connecting the area adjacent to the side panel and outside the housing to an area inside the housing;

a rear opening in the rear panel, the rear opening fluidly connecting an area adjacent to the rear panel and outside the housing to an area inside the housing;

an air mover that draws air into the upper opening; and an air mover that draws air into the rear opening.

2. The domestic kitchen appliance of claim 1, wherein the flange is a corner flange located at a corner of the housing between the area in front of the housing and the area adjacent to the side panel.

3. The domestic kitchen appliance of claim 2, wherein the corner flange is adjacent to an edge of the door when the door is in a closed position.

4. The domestic kitchen appliance of claim 3, wherein the flange openings are at least partially formed in a first planar portion of the corner flange, the first planar portion being parallel to a front face of the door.

5. The domestic kitchen appliance of claim 4, wherein the flange openings are at least partially formed in a second planar portion of the corner flange, the second planar portion being non-parallel to the front face of the door.

6. The domestic kitchen appliance of claim 3, wherein the flange openings are at least partially formed in a second planar portion of the corner flange, the second planar portion being non-parallel to a front face of the door.

7. The domestic kitchen appliance of claim 3, wherein the upper opening is located vertically higher than the rear opening.

8. The domestic kitchen appliance of claim 1, wherein the upper opening is located vertically higher than the rear opening.

9. An arrangement comprising:

two of the domestic kitchen appliances of claim 1 arranged with their respective side panels facing each other, wherein the area adjacent to the side panel of a first one of the two domestic kitchen appliances is the area adjacent to the side panel of a second one of the two domestic kitchen appliances.

10. An arrangement comprising:

at least two domestic kitchen appliances, each appliance comprising:

a housing having a side panel and a rear panel;

a cooking chamber inside the housing;

a door that is operable to access the cooking chamber;

a corner flange located at a corner of the housing between an area in front of the housing and an area adjacent to the side panel; and a plurality of flange openings in the corner flange, the flange openings fluidly connecting the area in front of the housing to the area adjacent to the side panel, wherein the area adjacent to the side panel of at least one unit of the two domestic kitchen appliances is the area adjacent to the side panel of a second unit of the two domestic kitchen appliances.

11. The arrangement of claim 10, wherein the corner flange is adjacent to an edge of the door when the door is in a closed position.

12. The arrangement of claim 11, wherein the flange openings are at least partially formed in a first planar portion of the corner flange, the first planar portion being parallel to a front face of the door.

13. The arrangement of claim 12, wherein the flange openings are at least partially formed in a second planar portion of the corner flange, the second planar portion being non-parallel to the front face of the door.

14. The arrangement of claim 11, wherein the flange openings are at least partially formed in a second planar portion of the corner flange, the second planar portion being non-parallel to a front face of the door.

15. The arrangement of claim 11, wherein the upper opening is located vertically higher than the rear opening.

16. The arrangement of claim 10, wherein the upper opening is located vertically higher than the rear opening.

17. A method of cooling a side panel of a domestic kitchen appliance, the domestic kitchen appliance having a housing having a side panel and a rear panel, a cooking chamber inside the housing, a door that is operable to access the cooking chamber, a corner flange located at a corner of the housing between an area in front of the housing and an area adjacent to the side panel, a plurality of flange openings in the corner flange, an upper opening in the housing, the upper opening being located above the side panel, and a rear opening in the rear panel, the method comprising: drawing cooling air with an upper opening air mover through the flange openings from the area in front of the housing, over the side panel, and into the upper opening; and drawing cooling air with a rear opening air mover through the flange openings from the area in front of the housing, over the side panel, and into the rear opening.

18. The method of claim 17, wherein the upper opening is located vertically higher than the rear opening.

19. The method of claim 18, wherein the rear opening comprises a plurality of openings that are arranged in a vertically manner relative to each other.

* * * * *